US010399844B1

(12) United States Patent
Laible

(10) Patent No.: US 10,399,844 B1
(45) Date of Patent: Sep. 3, 2019

(54) BAG INSERT

(71) Applicant: Rodney Laible, Omaha, NE (US)

(72) Inventor: Rodney Laible, Omaha, NE (US)

( * ) Notice: Subject to any disclaimer, the term of this patent is extended or adjusted under 35 U.S.C. 154(b) by 0 days.

(21) Appl. No.: 15/469,955

(22) Filed: Mar. 27, 2017

(51) Int. Cl.
*B67D 7/02* (2010.01)

(52) U.S. Cl.
CPC ..... *B67D 7/0294* (2013.01)

(58) Field of Classification Search
CPC ..... B65D 75/30
USPC ... 222/92, 96, 106, 107, 528, 529, 531, 532, 222/546; 206/210, 438–439
See application file for complete search history.

(56) References Cited

U.S. PATENT DOCUMENTS 3,951,148 A * 4/1976 Herb ..... A61J 1/2089 604/408
4,286,636 A * 9/1981 Credle ..... B65D 83/0055 141/114
4,862,918 A * 9/1989 Schroeder ..... B67D 7/0294 137/614.19
4,913,316 A * 4/1990 Richter ..... B67D 1/0078 137/594
5,072,756 A * 12/1991 Carr ..... B67D 3/042 137/614.04
5,255,713 A * 10/1993 Scholle ..... B67D 1/0835 137/535
5,699,936 A * 12/1997 Sakamoto ..... B65D 47/36 222/107
5,988,456 A 11/1999 Laible
6,142,345 A 11/2000 Laible
6,607,097 B2 * 8/2003 Savage ..... B65D 75/5877 220/62.12
6,669,062 B1 12/2003 Laible
6,986,443 B2 * 1/2006 Laible ..... B67D 7/0294 222/181.1
7,770,360 B2 * 8/2010 Smith ..... B65D 75/30 493/213
8,083,107 B2 * 12/2011 Laible ..... B65D 47/32 222/189.09
8,973,789 B2 * 3/2015 Smith ..... B65D 47/2031 222/105
9,242,847 B1 1/2016 Laible

* cited by examiner

*Primary Examiner* — Vishal Pancholi
(74) *Attorney, Agent, or Firm* — Dennis L. Thomte; Thomte Patent Law Office LLC

(57) ABSTRACT

An insert for use with a flexible liquid bag, having upper and lower ends, with the upper end of the bag having a hollow support structure with open upper and lower ends, mounted in an opening formed in the bag adjacent the upper end of the bag. The insert has open upper and lower ends with the lower end of the insert being received by the open upper end of the hollow support structure. A normally closed valve structure is positioned in the insert to prevent liquid from flowing therethrough. An actuator cap is threadably mounted on the upper end of the insert. The actuator cap includes structure to open the normally closed valve so that liquid in the bag may flow through the insert. The bag with the insert secured thereto will be inverted in use so that the liquid will flow downwardly from the bag.

1 Claim, 11 Drawing Sheets

BAG INSERT

BACKGROUND OF THE INVENTION

Field of the Invention

This invention relates to a bag insert for use with a flexible liquid bag. More particularly, this invention relates to a bag insert which may be connected to a bag insert mounting structure on the bag whereby the filled bag may be safely shipped to a place of use. Even more particularly, this invention relates to a bag insert which enables the liquid contents of the bag to be dispensed therefrom.

Description of the Related Art

Liquid inoculants are frequently placed in flexible bags for shipment to places where seeds or the like are inoculated with the liquid inoculate. During shipment, the structure which forms an inlet-discharge opening in the bag may leak. Further, once the seeds or the like are to be inoculated, the discharge of the liquid inoculant from the bag is difficult and may result in spillage of the inoculant.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

An insert is described for use with a flexible liquid bag, having upper and lower ends, with the upper end of the bag having a hollow support structure, having open upper and lower ends, mounted in an opening formed in the bag adjacent the upper end of the bag. The insert includes a generally cylindrical body member having an open upper end and an open lower end with the upper and lower ends having inner and outer sides. The upper end of the body member has external threads formed in its outer side. The lower end of the body member is configured to be frictionally inserted into the upper end of the hollow support structure to attach the body member to the hollow support structure. A horizontally disposed wall member is provided in the body member below the upper end thereof with the wall member having a central opening formed therein. The lower end of the body member has internal threads formed therein above the lower end thereof.

The insert also includes an upstanding hollow and generally tubular first receiver, having an open upper end and an open lower end, which extends upwardly from the wall member with the open lower end of the first receiver being in fluid communication with the central opening in the wall member. The first receiver includes an upper cylindrical portion and a lower cylindrical portion. The lower cylindrical portion of the first receiver has a greater diameter than the upper cylindrical portion thereof to create a first annular shoulder therebetween.

The bag insert also includes a retainer including a disc member having external threads on its periphery with the disc member having an upper side and a lower side. The external threads on the disc member are complimentary to the internal threads in the lower end of the body member whereby the retainer may be threadably secured to the body member. The retainer includes an upstanding hollow valve body, having upper and lower ends, which extends upwardly and downwardly therefrom respectively. The lower end of the valve body is open and the upper end of the valve body is closed. The valve body has one or more openings formed therein below the upper end thereof. The bag insert also includes a hollow upstanding valve stem having a generally cylindrical upper portion with upper and lower ends and a generally cylindrical lower portion with upper and lower ends. The valve stem has an annular shoulder which extends outwardly from the valve stem at the lower end of the cylindrical upper portion thereof. The valve stem slidably embraces the valve body. The valve stem is selectively movable between upper and lower positions with respect to the valve body. A spring, having upper and lower ends, embraces the valve body between the disc member and the annular shoulder on the valve stem for yieldably urging the valve stem to its upper position. The generally cylindrical upper portion of the valve stem closes the one or more openings in the valve body when the valve body is in its upper position. The one or more openings in the valve body are open when the valve body is in its lower position. The lower end of the valve body is in fluid communication with the liquid in the bag.

The bag insert also includes an actuator cap which is selectively removably threadably mounted on the exterior threads on the upper end of the body member after the bag has been inverted so that the insert is positioned at the inverted lower end of the bag. The actuator cap has structure associated therewith which engages the valve stem to move the valve stem relative to the valve body to open the one or more openings in the valve body to permit the liquid in the bag to flow downwardly and outwardly from the insert.

The bag insert also includes a shipping cap which is selectively threadably mounted on the external threads of the body member prior to the actuator cap being threadably mounted on the body member. In the preferred embodiment, the flexible liquid bag is a flexible liquid inoculate bag.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
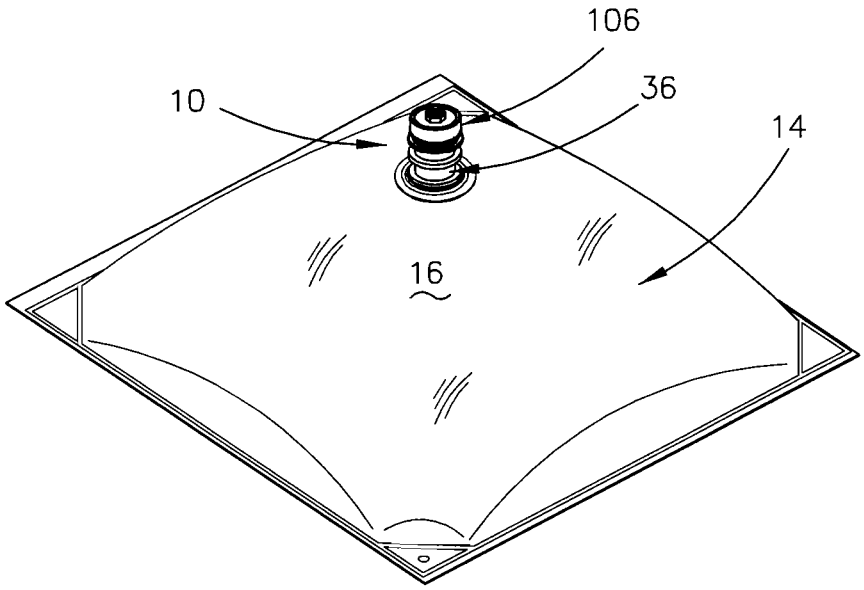
FIG. 1 is a perspective view of a liquid bag having the bag insert of this invention mounted therein.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The bag insert of this invention is referred to by the reference numeral 10 as will be described in detail hereinafter. Bag insert 10 is designed to be inserted into a circular opening 12 formed in a flexible bag 14. Bag 14 will be described as having a first side panel 16 and a second side panel 18. The opening 12 may be formed in either the first side panel 16 or the second side panel 18. For purposes of description, the opening 12 will be described as being formed in the first side panel 16 near the upper end near one side edge of first side panel 16.

Side panel 16 will be described as having an upper end 20, a lower end 22, a first side edge 24 and a second side edge 26. Side panel 18 will be described as having an upper end 28, a lower end 30, a first side edge 32 and a second side edge 34.

The upper end 20 of side panel 16 is sealed to the upper end 28 of side panel 18. The first side edge 24 of side panel 16 is sealed to the first side edge 32 of side panel 18. The second side edge 26 of side panel 16 is sealed to the second side edge 34 of side panel 18. The lower end 22 of side panel 16 is sealed to the lower end 30 of side panel 18. The opening 12 is shown to be formed in side panel 16 but could be formed in side panel 18. Opening 12 is formed in side panel 16 near the upper end 20 thereof. Opening 12 could also be centrally located between the side edges 24 and 26 of side panel 10 but it is preferred that opening 12 be formed in side panel 16 as shown in the drawings.

The numeral 36 refers to a hollow support structure which is mounted in opening 12. Support structure 36 includes a disc-shaped ring member 38 having a central opening 39 formed therein. Integrally formed with ring member 38 is an annular rib 40 which extends upwardly from the upper outer side of ring member 38. A hollow cylindrical body member 42 is integrally formed or molded with ring member 38 and rib 40 and extends upwardly therefrom. The upper end of body member 42 preferably has an annular rib 44 extending outwardly therefrom. Preferably, an annular rib 46 is integrally formed with body member 42 and extends outwardly therefrom below the upper end of body member 42.

Figure 8:
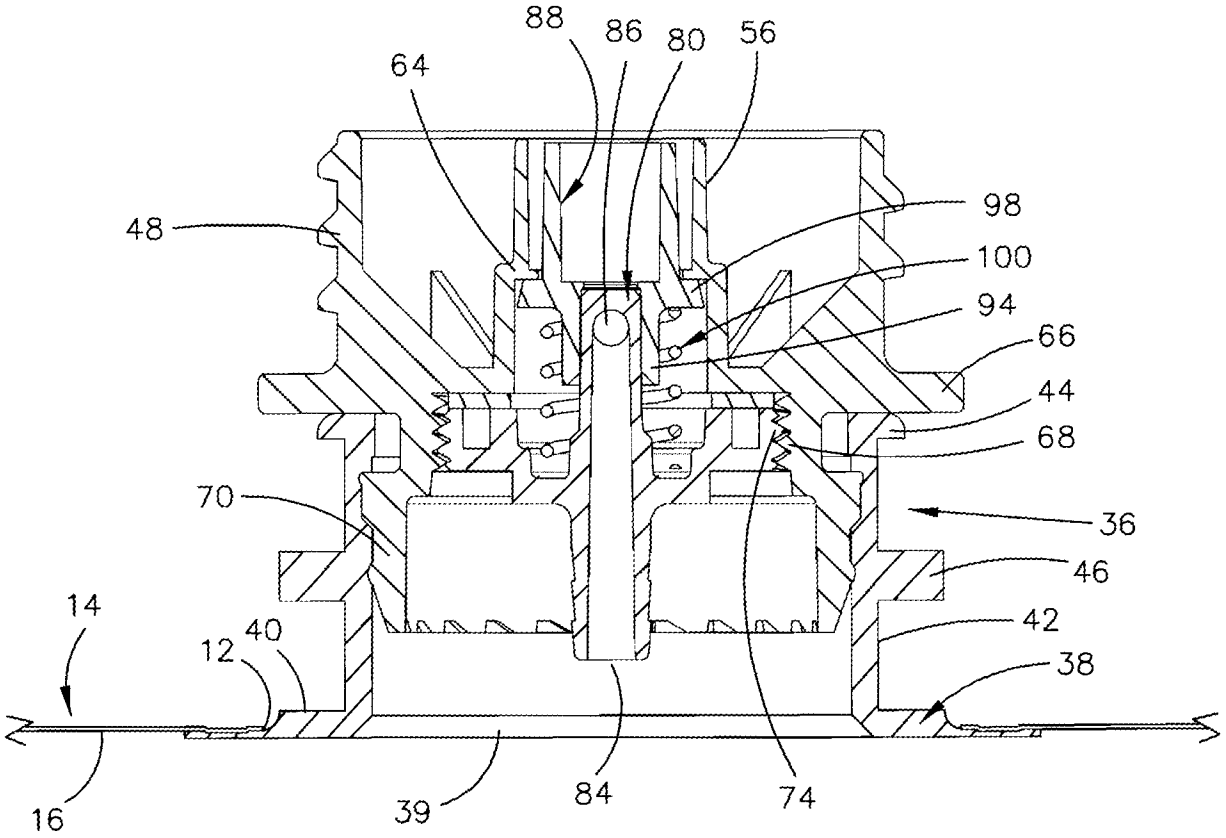
FIG. 8 is a sectional view of the bag insert of this invention inserted into the mounting structure of the bag.

Insert 10 is press-fitted into the open upper end of support structure 36 as seen in FIG. 8. Insert 10 includes external threads 48 at its upper end. Insert 10 includes an open upper end 50, an open lower end 52, and a cylindrical wall member 54 which extends downwardly thereinto from its upper end 50 as seen in the drawings. The numeral 56 refers to an upstanding hollow receiver which is integrally formed or molded with insert 10 and which has an upper end 58 and a lower end 60. As seen, receiver 56 has an enlarged diameter portion 62 at its lower end which defines a shoulder 64.

Insert 10 includes an annular rib 66 which extends outwardly therefrom at the lower end of receiver 56. The lower open end of insert 10 has internal threads 68 formed therein. The lower end 52 of insert 10 has a smaller diameter than the upper end 50 thereof. Internal threads 68 are provided in insert 10 above the lower end thereof. The lower end of insert 10 has a ribbed and tapered outer side 70.

Insert 10 includes a disc member or liner retainer 72 having external threads 74 which are complimentary to the internal threads 68 in insert 10 so that the liner retainer 72 may be threadably secured to the lower end of insert 10. The upper surface of liner retainer 72 has an annular groove or recess 76 formed therein which is configured to have the flat ring-shaped liner 78 positioned thereon. The numeral 80 refers to a hollow valve body which is integrally formed with liner retainer 72 and which includes an upper end 82 and a lower end 84. The upper end 82 of valve body is closed, as seen in the drawings. The side wall of valve body 80 is provided with a pair of openings 86 formed therein below the upper end 82 to permit the liquid passing from bag 14, to pass through valve body 80, as will be described in detail hereinafter.

The numeral 88 refers to a valve stem which is generally cylindrical and which includes an upper cylindrical body portion 90 having a bore 92 formed therein. Valve stem 88 also includes a generally cylindrical lower body portion 94 having a bore 96 formed therein. Bore 92 has a greater diameter than bore 96. An annular shoulder, rim or rib 98 extends outwardly from valve stem 88 between body portions 90 and 94. The numeral 100 refers to a spring having a lower end 102 and an upper end 104. The lower end 102 of spring 100 embraces the valve body 80 and engages the upper side of the liner retainer 72. The upper end 104 of spring 100 engages the lower end of annular shoulder 98 of valve stem 88 to yieldably urge valve stem 88 to its upper position, as seen in FIG. 8, wherein the upper end of shoulder 98 sealably engages the lower end of shoulder 67. In the upper position of valve stem 88, the openings 86 are closed by the cylindrical body portion 94 thereby preventing liquid from the bag from passing through insert 10.

Figure 9:
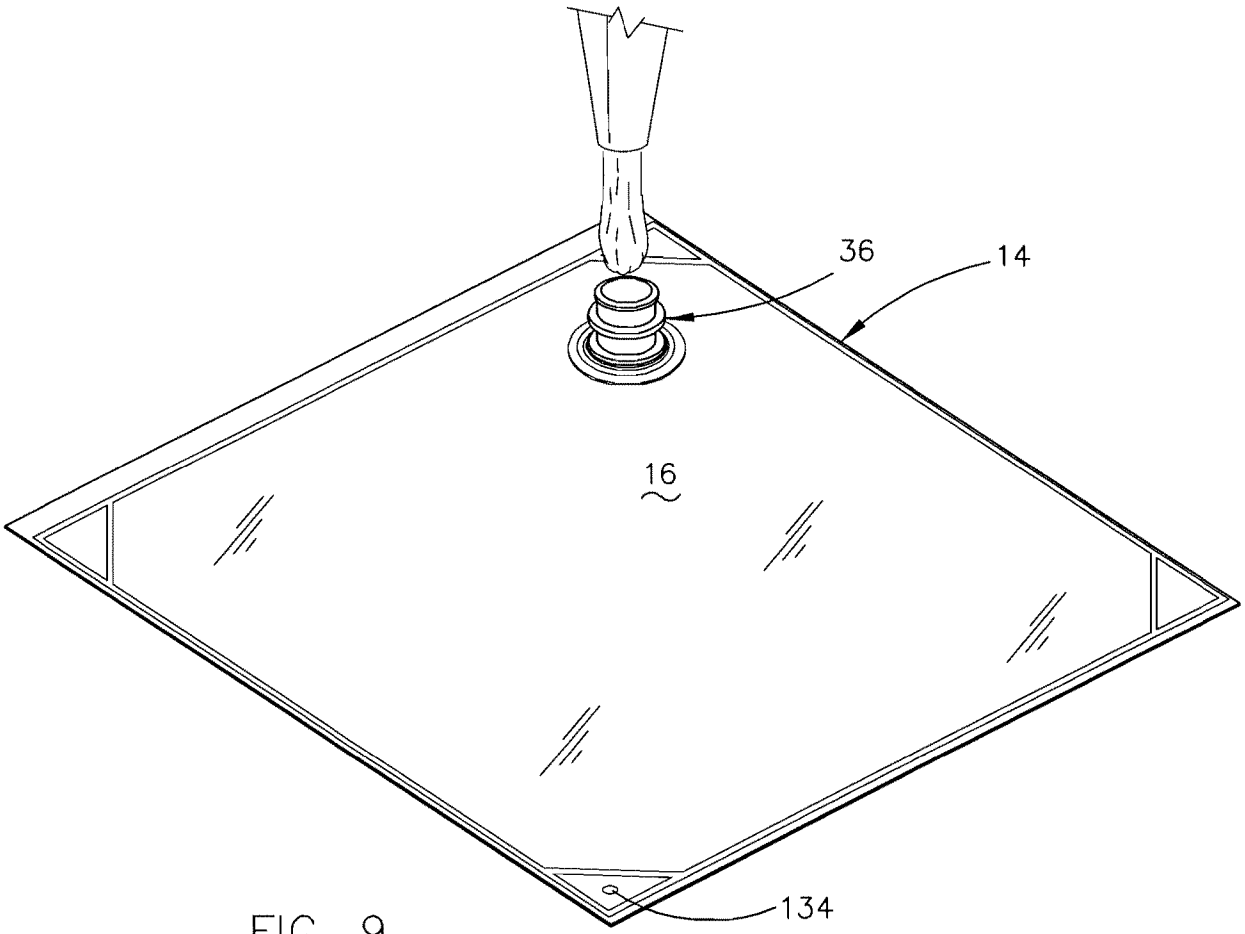
FIG. 9 is a perspective view illustrating the bag being filled with liquid by way of the mounting structure of the bag.
Figure 10:
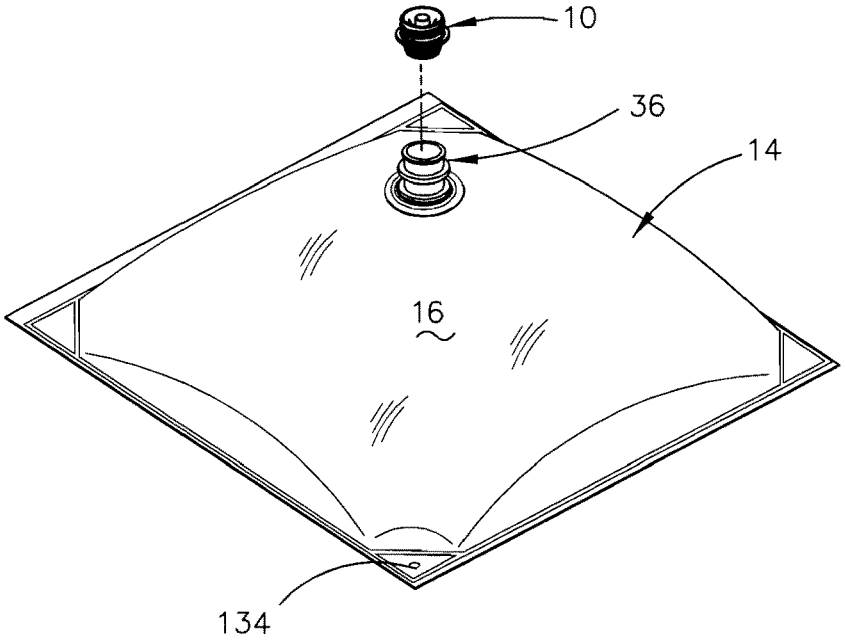
FIG. 10 is a perspective view illustrating the bag insert of this invention which illustrates the manner in which the insert is inserted into the filled bag.
Figure 11:
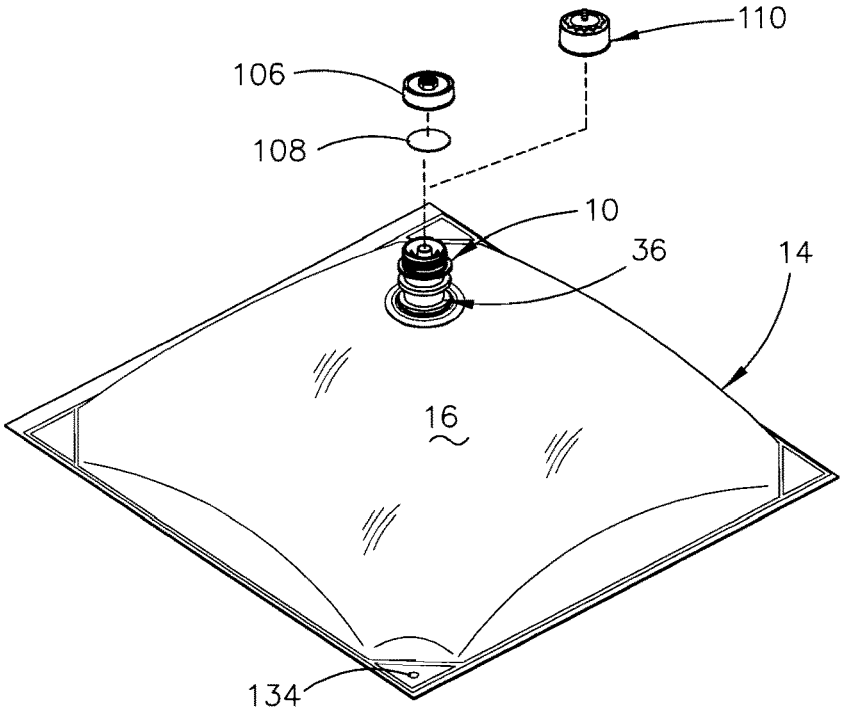
FIG. 11 illustrates the relationship of a shipping cap and the bag insert and which also illustrates the relationship of the actuator cap of the bag insert of this invention.
Figure 12:
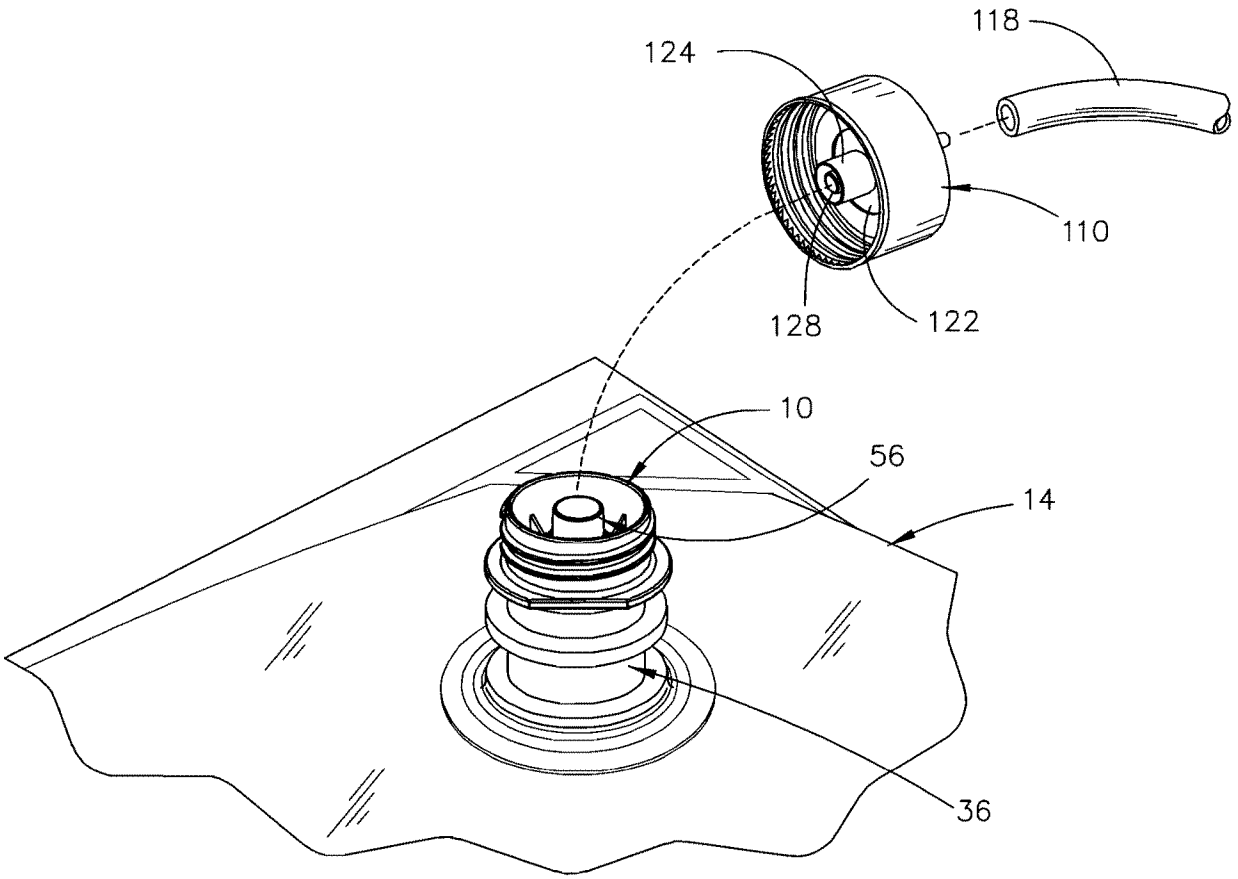
FIG. 12 is an exploded perspective view illustrating the actuator cap and a discharge tube about to be attached to the bag insert of this invention.
Figure 13:
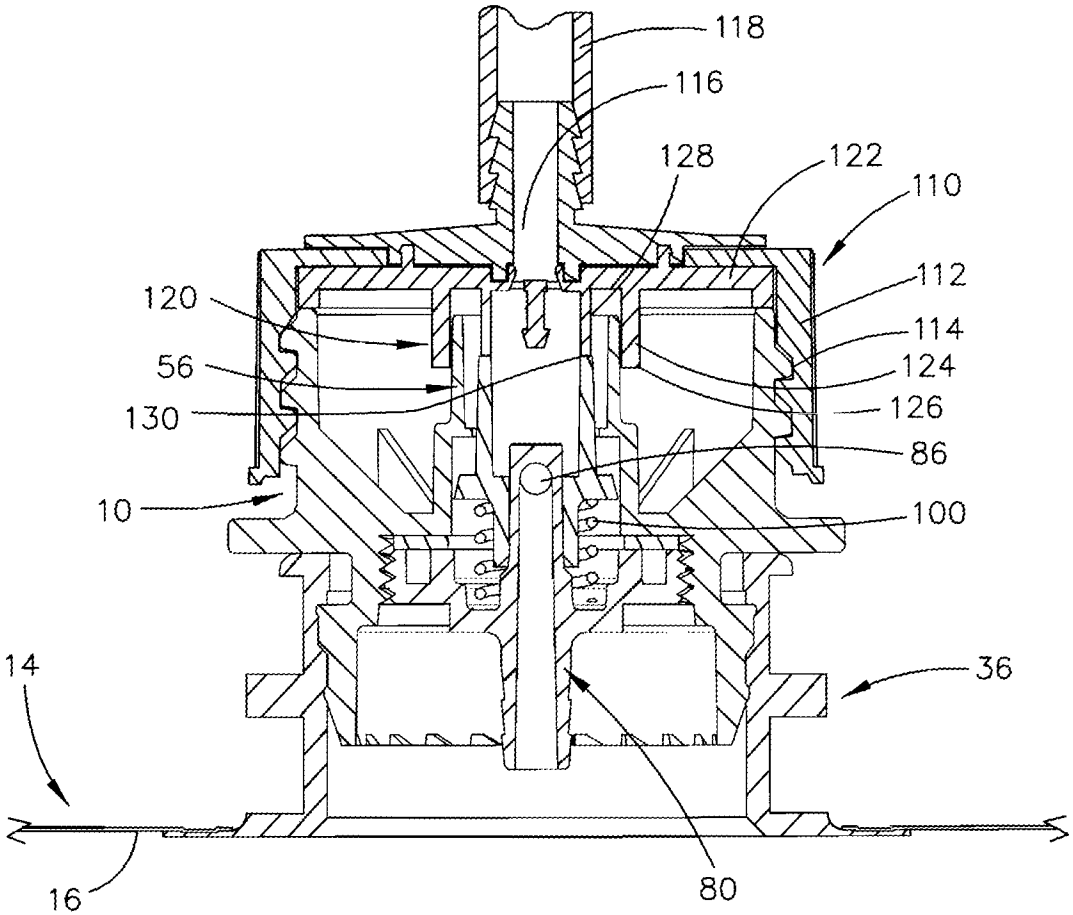
FIG. 13 is a sectional view of the actuator cap mounted on the bag insert which is secured to the bag mounting structure of the bag.

The bag 14 will be initially in the FIG. 1 upright position so that liquid, such as an inoculate material, may be inserted downwardly into the hollow support structure 36 as seen in FIG. 9. When the bag 14 has been filled, the lower end 52 of insert 10 is frictionally inserted downwardly into the open upper end 50 of support structure 36 until rib or shoulder 66 engages the annular rib 44 of support structure 36. The tapered and ribbed outer surface 70 of insert 10 frictionally engages the inner surface of the body member 42 to maintain the insert 10 in support structure 36. At that time, the valve stem 88 will be in its upper position to close the openings 86 in valve stem 88.

When the insert 10 has been attached to the support structure 36, the bag 14 will be prepared for shipment by screwing an internally threaded shipping cap 106 onto the exterior threads 48 of insert 10 to prevent the liquid in bag 14 from draining therefrom if valve stem 88 is somehow moved to its open position during shipment. Preferably, a flat disc-shaped liner member 108 is positioned within cap 106 for sealable engagement with the upper end of insert 10.

When the bag 14 has arrived at its intended location, the bag 14 is prepared for use. While the bag 14 is preferably in its upright or generally upright position, shipping cap 106 is threadably removed from insert 10. At that time, an actuator cap 110 is then threaded onto the external threads 48 of insert 10. Cap 110 will be described in detail and functions in a similar manner as disclosed in my U.S. Pat. Nos. 5,988,456; 6,142,345; 8,083,107; and 9,242,847, the disclosures of which are incorporated hereinto by reference thereto to complete this disclosure if necessary.

Cap 110 includes a locking collar 112 having internal threads 114 which are adapted to be threadably connected to external threads 48 on insert 10. Collar 112 is provided with a central opening 116 formed therein. The outer end of central opening 116 is in fluid communication with a discharge tube 118. A receiver assembly 120 extends downwardly from the underside of collar 112. Receiver assembly 120 includes a disc member 122 which is rotatably positioned at the underside of collar 112. An outer tubular receiver member 124 is integrally formed with disc member 122 and extends downwardly therefrom to its lower end 126. An inner tubular receiver member 128 is integrally formed with disc member 122 and extends downwardly therefrom within outer tubular receiver member 124. The upper end of inner tubular receiver member 128 is in fluid communication with the discharge tube 118. Inner tubular receiver member 128 has a diameter at its lower end 130 which is configured to engage the upper end of valve stem 88. As seen, the lower end 126 of receiver member 124 is positioned slightly below the lower end 130 of receiver member 128. When locking collar 112 of actuator cap 110 is screwed onto threads 48, the lower end 126 of receiver member 124 embraces the upper end of receiver 56 and the lower end 130 of receiver member 128 engages the upper end of valve stem 88 to push valve stem 88 downwardly against the resistance of spring 100 thereby opening the pair of openings 86. When the pair of openings 86 are open, liquid may flow through the bag insert 10 and outwardly from the discharge tube 118.

Figure 1A:
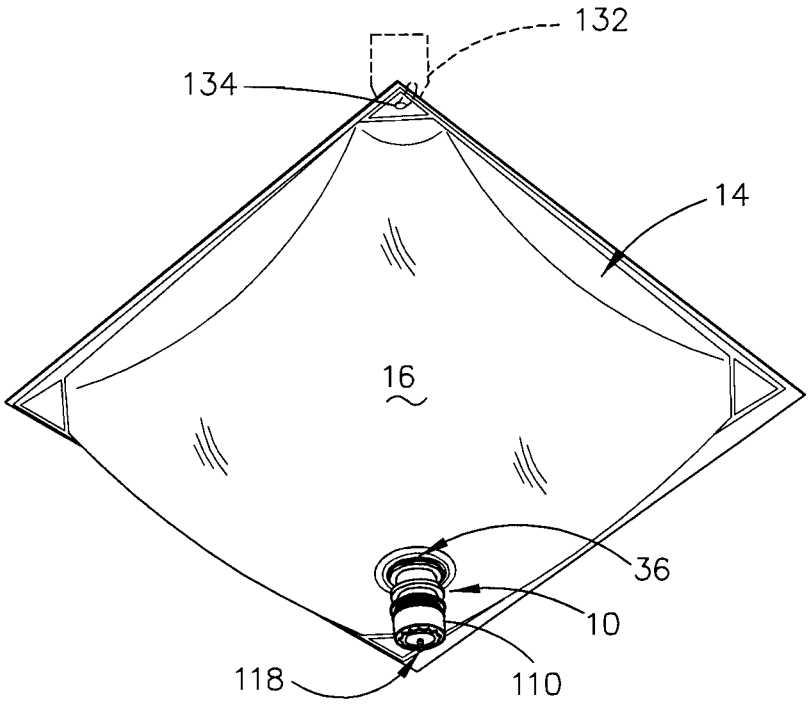
FIG. 1A is a view similar to FIG. 1 except that the bag of FIG. 1 has been inverted and hung from a support.
Figure 2:
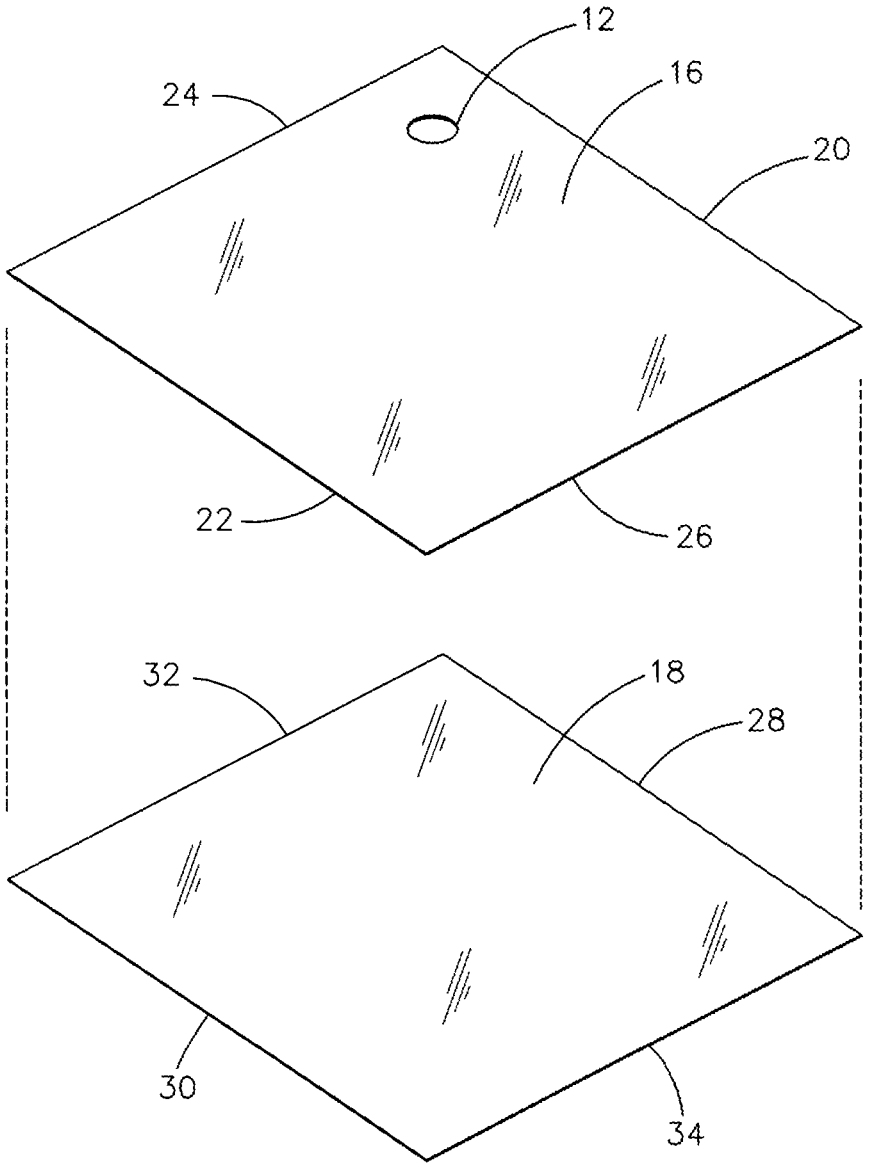
FIG. 2 is an exploded perspective view of the first and second side panels of the liquid bag.
Figure 3:
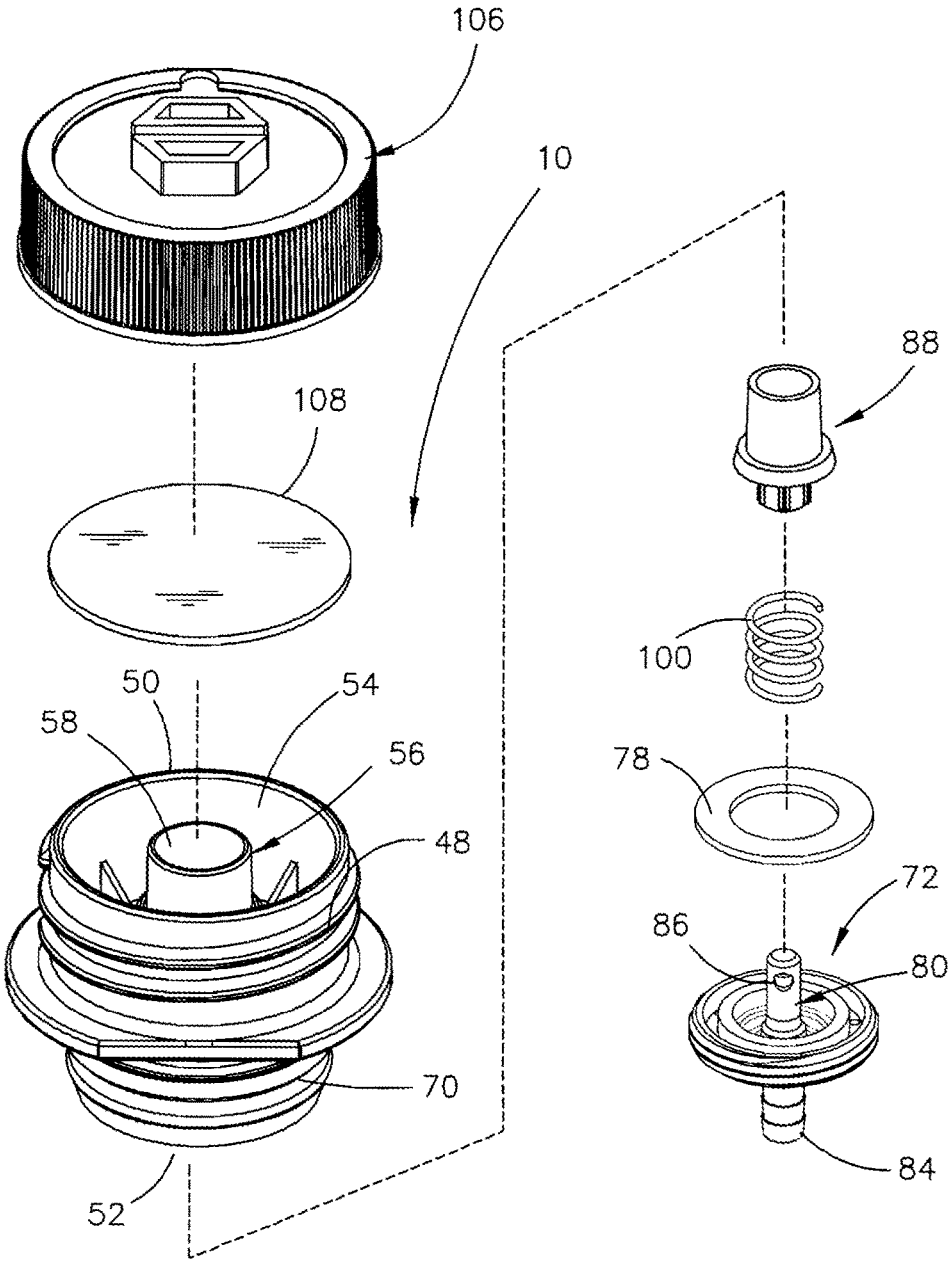
FIG. 3 is an exploded perspective view of the bag insert of this invention.
Figure 4:
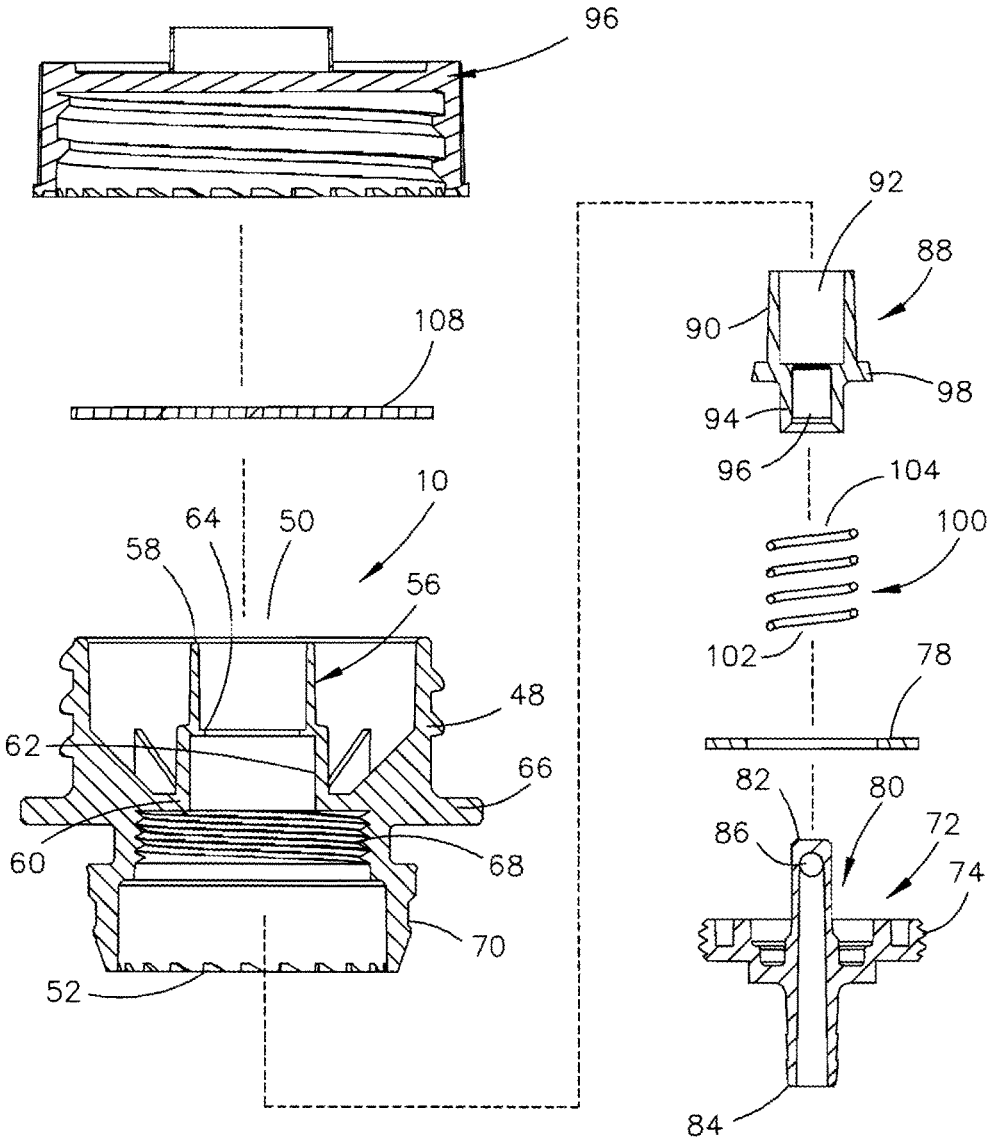
FIG. 4 is an exploded sectional view of the bag insert of this invention.
Figure 5:
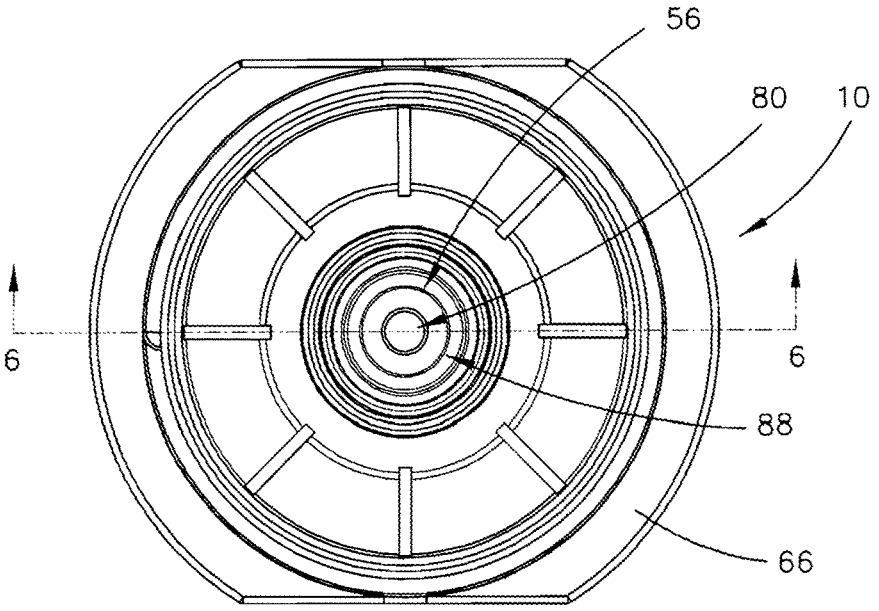
FIG. 5 is a top view of the bag insert of this invention which is adapted to have a shipping cap or an actuator cap mounted on the upper end thereof.
Figure 6:
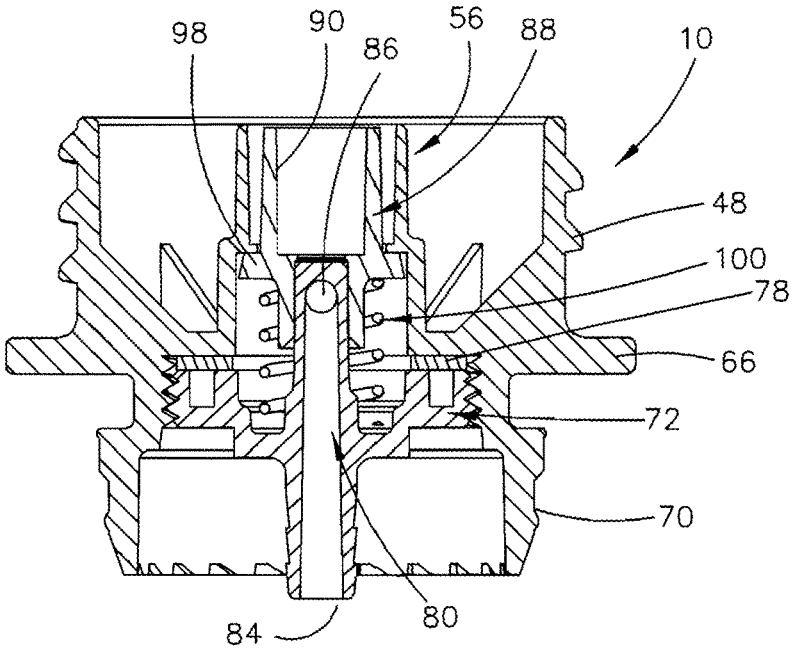
FIG. 6 is a sectional view as seen on lines 6-6 of FIG. 5.
Figure 7:
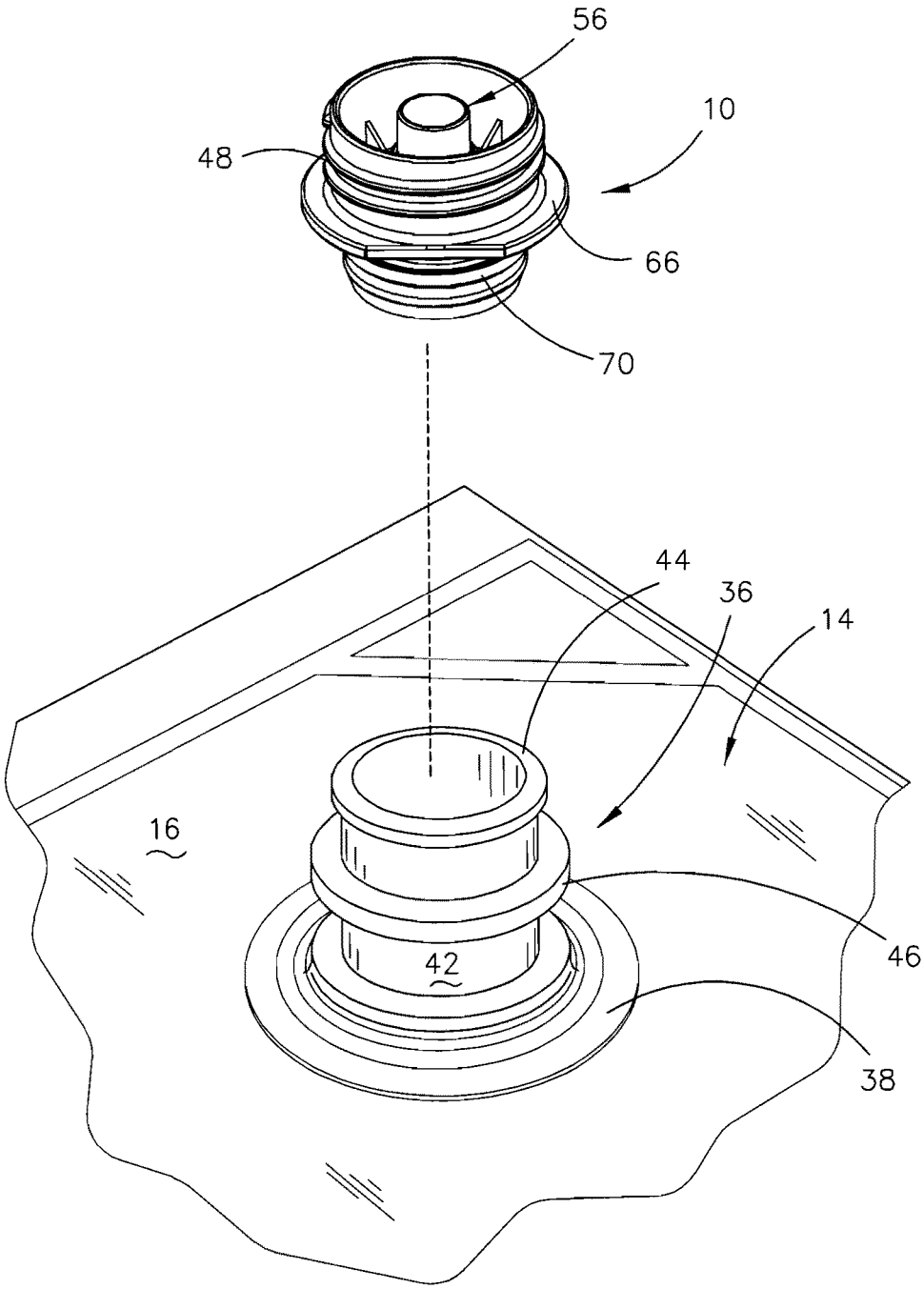
FIG. 7 is a perspective view illustrating the bag insert of this invention which illustrates the manner in which the bag insert is inserted into the mounting structure of the bag.

Usually, the actuator cap will not be secured to the bag insert until the bag has been inverted to the position of FIG. 1A, so that the liquid in bag 14 will flow downwardly from the bag 14 for gravity discharge through the discharge tube 118 for whatever purpose. As seen in FIG. 1A, the bag, when in its inverted position, is held in that position by a support 132 which receives an opening 134 in bag 14.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. In combination:

a flexible liquid bag having upper and lower ends;

said flexible liquid bag being configured to be inverted;

said flexible liquid bag having a first opening formed therein adjacent said upper end thereof;

a hollow support structure, having open upper and lower ends, mounted in said first opening;

said hollow support structure having an annular rib extending outwardly from said upper end thereof;

said flexible liquid bag having a second opening formed therein adjacent said lower end of said bag which is configured to receive a bag support therein when said flexible liquid bag is inverted;

an insert for use with said flexible liquid bag;

said insert comprising:

(a) a generally cylindrical body member having an open upper end and an open lower end with said upper and lower ends having inner and outer sides;

(b) said upper end of said body member having external threads formed in said outer side thereof;

(c) said body member having an annular rib extending outwardly therefrom above said lower end thereof;

(d) said lower end of said body member being configured to be frictionally inserted downwardly into said upper end of said hollow support structure to attach said body member to said hollow support structure;

(e) said annular rib of said body member of said insert being in engagement with said annular rib of said hollow support structure to limit the downward movement of said lower end of said body member with respect to said hollow support structure when said lower end of said body member is inserted into said upper end of said hollow support structure to attach said body member to said hollow support structure;

(f) a horizontally disposed wall member in said body member below said upper end of said body member;

(g) said horizontally disposed wall member having a central opening formed therein;

(h) said body member having internal threads formed therein above said lower end thereof;

(i) an upstanding hollow and generally tubular first receiver, having an open upper end and an open lower end, extending upwardly from said horizontally disposed wall member with said open lower end of said first receiver being in fluid communication with said central opening in said horizontally disposed wall member;

(j) said first receiver having an upper cylindrical portion and a lower cylindrical portion;

(k) said lower cylindrical portion of said first receiver having a greater diameter than said upper cylindrical portion to create a first annular shoulder therebetween;

(l) a first annular rib extending outwardly from said body member above said lower end of said body member;

(m) a retainer including a disc member having external threads on its periphery and having an upper side and a lower side;

(n) said external threads on said disc member being complimentary to said internal threads in said lower end of said body member whereby said retainer may be threadably secured to said body member;

(o) said retainer including an upstanding hollow valve body, having upper and lower ends, which extends upwardly and downwardly therefrom respectively;

(p) said lower end of said valve body being open;

(q) said upper end of said valve body being closed;

(r) said valve body having one or more openings formed therein below said upper end thereof;

(s) a hollow upstanding valve stem having a generally cylindrical upper portion with upper and lower ends and a generally cylindrical lower portion with upper and lower ends;

(t) said valve stem having an annular shoulder which extends outwardly from said valve stem at said lower end of said cylindrical upper portion thereof;

(u) said valve stem slidably embracing said valve body;

(v) said valve stem being selectively movable between upper and lower positions with respect to said valve body;

(w) a spring, having upper and lower ends, embracing said valve body between said disc member and said annular shoulder on said valve stem for yieldably urging said valve stem to its said upper position;

(x) said generally cylindrical lower portion of said valve stem closing said one or more openings in said valve body when said valve body is in its said upper position;

(y) said one or more openings in said valve body being open when said valve body is in its said lower position;

(z) said lower end of said valve body being in fluid communication with the liquid in the bag;

(aa) an actuator cap for selectively removably threadably mounting on said exterior threads on said upper end of said body member after the bag has been inverted so that said insert is positioned at the inverted lower end of said bag;

(bb) said actuator cap having structure associated therewith which engages said valve stem to move valve stem relative to said valve body to open said one or more openings in said valve body to permit the liquid in the bag to flow downwardly and outwardly from said insert;

(cc) a flat disc-shaped liner member positioned on said upper end of said body member for sealable engagement with said upper end of said body member when said actuator cap is not threadably mounted on said body member;

(dd) a shipping cap selectively threadably mounted on said external threads on said body member, when said actuator cap is not threadably mounted on said body member;

(ee) said flat disc-shaped liner being positioned within said shipping cap when said shipping cap is threadably mounted on said external threads on said body member; and (ff) said shipping cap being spaced from said valve stem when said shipping cap is threadably mounted on said external threads on said body member so that said valve stem will not be moved relative to said valve body thereby preventing the opening of said one or more openings in said valve body.

* * * * *